US005362038A

United States Patent [19]

Giles et al.

[11] Patent Number: 5,362,038

[45] Date of Patent: Nov. 8, 1994

[54] SHEET FEEDER FOR COMPUTER DRIVEN PRINTER

[75] Inventors: Robert Giles, Escondido, Calif.; Timothy Zantow, deceased, late of Elm Grove, Wis., by Scott W. Zantow, administrator

[73] Assignee: Hewlett-Packard Company, Palo Alto, Calif.

[21] Appl. No.: 55,649

[22] Filed: Apr. 30, 1993

[51] Int. Cl.[5] ..... B65H 5/00

[52] U.S. Cl. ..... 271/10; 271/110; 271/118; 271/242; 271/270; 271/225

[58] Field of Search ..... 271/10, 110, 111, 117, 271/118, 126, 127, 225, 227, 242, 270

[56] References Cited

U.S. PATENT DOCUMENTS

| | | | |
|---|---|---|---|
| 4,337,935 | 7/1982 | Sawada et al. | 271/242 |
| 4,361,399 | 11/1982 | Sawada et al. | 271/242 |
| 4,523,832 | 6/1985 | Strutt et al. | 271/10 |
| 4,548,394 | 10/1985 | Koyama et al. | 271/10 |
| 4,577,849 | 3/1986 | Watanabe | 271/10 |
| 5,104,110 | 4/1992 | Haibara | 271/270 |

FOREIGN PATENT DOCUMENTS

| | | | |
|---|---|---|---|
| 0036049 | 2/1984 | Japan | 271/10 |
| 0197332 | 9/1986 | Japan | 271/242 |
| 4-59539 | 2/1992 | Japan | 271/10 |

*Primary Examiner*—H. Grant Skaggs

[57] ABSTRACT

A sheet feeder for a computer driven printer moves a sheet of paper from a supply stack to a holding station at which movement of the sheet of paper is temporarily stopped. Any skew present in the leading edge of the paper is automatically removed by engagement of the leading edge with a pair of spaced bights between opposed rollers before the paper progresses from the holding station to a printing station. One sheet of paper can temporarily remain in the holding station as a previously fed sheet of paper is simultaneously being passed from the holding station to the printing station or it can pass essentially continuously through the holding station on its way to the printing station. Separate motors for driving paper feed rollers and paper drive rollers permit implementation of different algorithms to accomplish this objective.

10 Claims, 4 Drawing Sheets

SHEET FEEDER FOR COMPUTER DRIVEN PRINTER

CROSS REFERENCE TO RELATED APPLICATIONS, IF ANY

None.

BACKGROUND OF THE INVENTION AND PRIOR ART

The present invention relates to print media sheet feeders for computer driven printer/plotters of the type which have a path of travel of the paper or other print medium through the printer in a fore and aft direction and a print head carriage mounted on one or more slider rods which moves back and forth transversely of the path of paper travel through the printer. As used herein, the term "paper" is used for convenience but is intended to include other media on which printing is to take place such as transparent sheets and the like.

Typical prior art printers use paper feeders which pick a sheet of paper from a stack and continuously feed the sheet from the stack through the printer past the print heads to an output tray or basket. In such arrangements, the printing cannot commence until the sheet of paper has traversed the entire length of the paper path from the paper stack to the printing station. Also, the sheet of paper often becomes skewed during passage from the stack to the printing station.

Accordingly, it is an object of the present invention to reduce the time for printing and to de-skew the paper immediately before it enters the print station.

SUMMARY OF THE INVENTION

The present invention provides a method of feeding sheets of paper from a stack thereof in a path of paper travel through a computer-driven printer/plotter comprising the steps of:

a) rotating a sheet feed roller which engages a leading edge portion of a sheet of paper in said stack to move said paper from said stack to a holding station in said printer;

b) guiding said sheet of paper in movement from said stack to said holding station where the leading edge of said sheet of paper is proximate a pair of spaced bights between spaced pairs of opposed rollers in the printer and at which further movement of the sheet of paper is temporarily stopped;

c) terminating movement of paper from said stack by said sheet feed roller; and d) commencing rotation of said drive rollers to move said sheet of paper between said drive rollers and said pinch rollers from said holding station through a printing station when the leading edge portion of said paper is engaged with each of said bights at said holding station, said bights being defined by opposed sheet drive rollers and pinch rollers located on opposite sides of the centerline of the path of paper travel.

With the above method, the waiting time for printing can be reduced by moving a sheet of paper to a holding station near the printing station while printing is taking place on another sheet which has already been de-skewed and passed through the holding station.

The method is implemented in a sheet feeder for a computer-driven printer comprising:

a) a sheet feed roller and means for intermittently rotating said sheet feed roller to feed a sheet of paper from a stack of paper to a holding station;

b) at least one sheet drive roller on each side of and spaced from the centerline of paper travel and means for intermittently rotating said drive rollers to drive a sheet of paper from said holding location to a printing station;

c) a plurality of pinch rollers between said holding station and said printing station, each said pinch roller being opposed to and biased toward an associated drive roller to define a paper path therebetween;

d) guide means for guiding a sheet of paper from said stack to position the leading edge thereof in bights between said opposed drive rollers and pinch rollers; and e) roller drive timing means for energizing said means for intermittently rotating said sheet feed roller to move said sheet until the leading edge thereof is engaged with each of said bights and thereafter energizing said means for intermittently rotating said drive rollers to move said sheet through said bights to said printing station.

A preferred embodiment of sheet feeder uses two separate motors for feeding the paper to a holding station and then for moving it from the holding station through a printing station at which printing takes place. This permits implementation of various paper de-skew algorithms which control the intermittent operation of the motors and associated paper moving rollers.

DESCRIPTION OF THE PREFERRED EMBODIMENT

The invention is described without reference to a specific embodiment of computer driven printer since it will be apparent to persons skilled in the art that the sheet feeder disclosed herein is adaptable, with minor modification, to many different types of printers.

Figure 1:
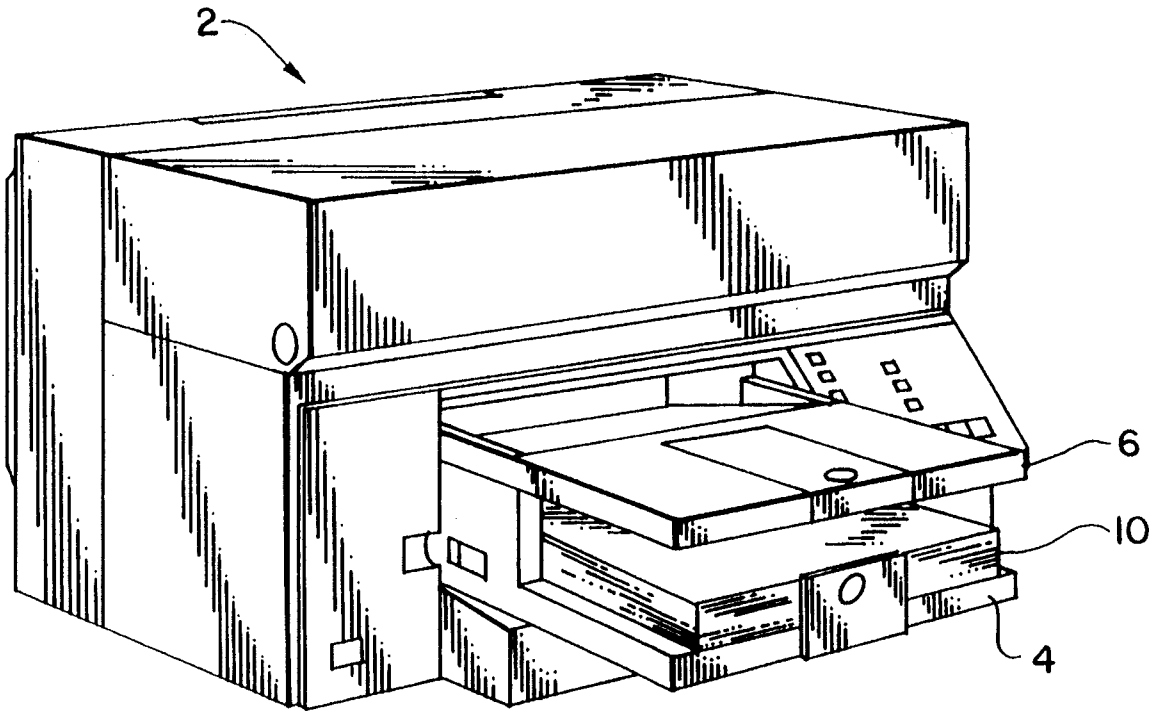
FIG. 1 is a perspective view of a color desktop printer embodying the teachings of the present invention.
Figure 2:
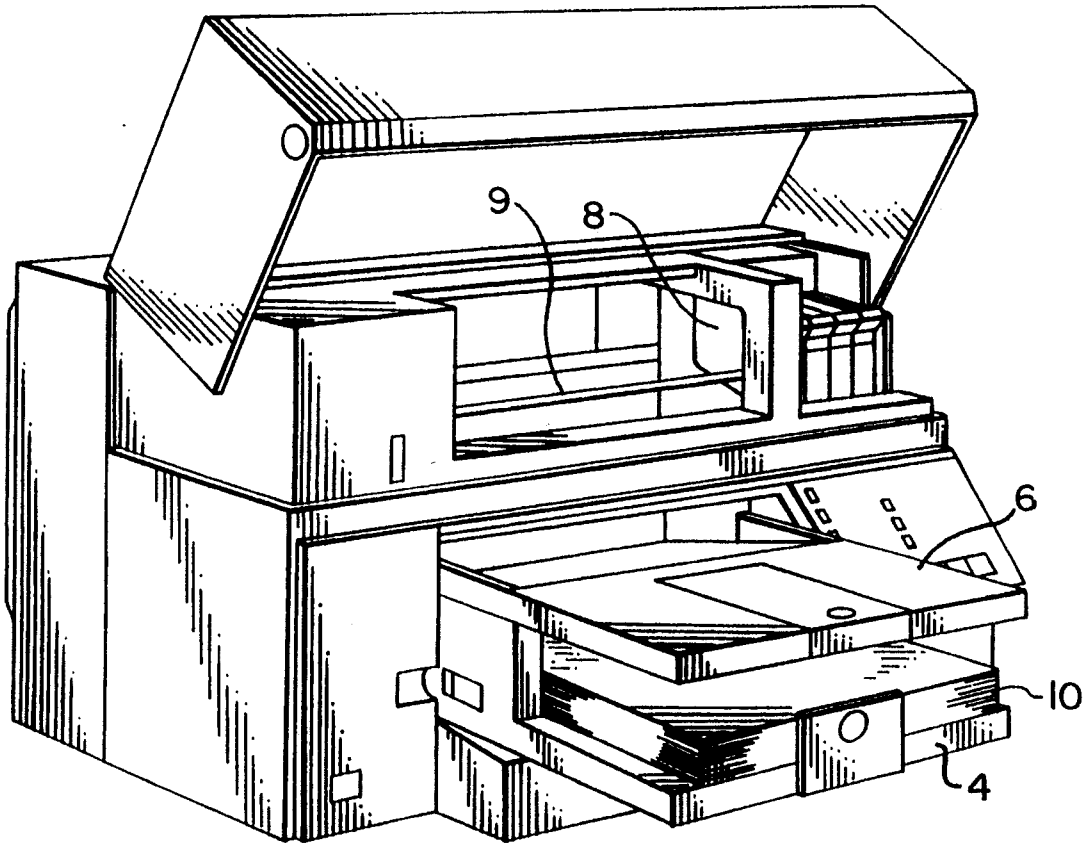
FIG. 2 is a perspective view of the printer of FIG. 1 with the cover open to reveal a printer carriage and print head cartridges therein.
Figure 3:
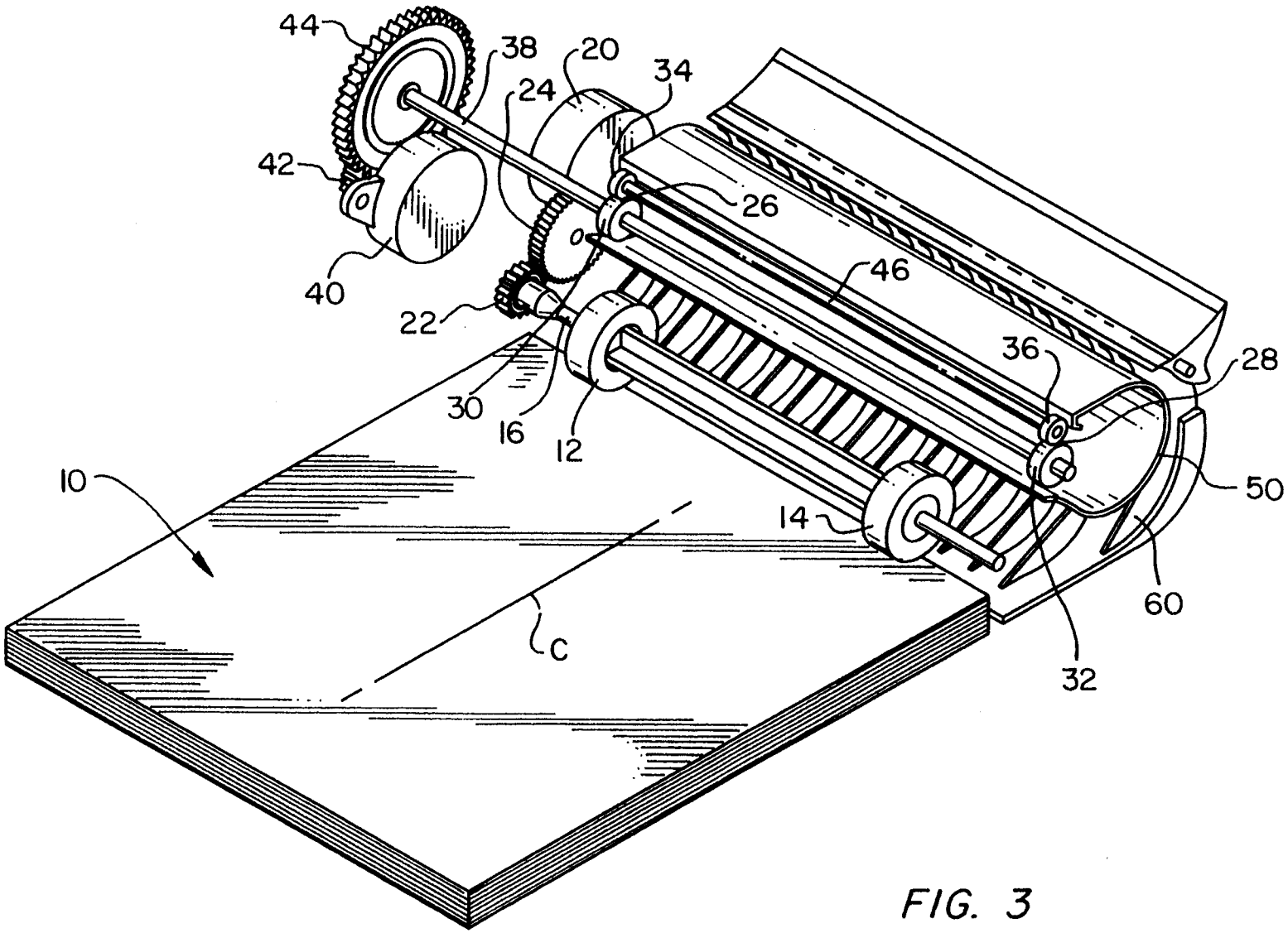
FIG. 3 is a schematic perspective view showing a stack of sheets of paper or other print media and an improved feed arrangement for moving paper into and through the printer of FIG. 1.

The printer 2 has vertically spaced paper input and output trays 4, 6 and a print head carriage 8 which moves transversely in the printer on slider rods 9. Individual sheets of paper are fed from a stack 10 by at least one and preferably two spaced sheet feed rollers 12, 14 (FIG. 3) mounted on a single horizontal shaft 16 which is driven by an intermittently operable electrically driven sheet feed motor 20 which is connected to the feed roller drive shaft by a transmission having a plurality of gears 22, 24. One or more sheet feed rollers can be used and each sheet feed roller 12, 14 typically will have a rubber or similar traction surface for peeling off the top sheet from the stack 10 of paper and moving it to a holding station in the printer at which movement of the paper is temporarily stopped. Paper movement may be stopped by terminating rotation of the feed roller or by lowering the paper stack away from the feed roller when the leading edge of the paper is in close proximity to, but not contacting, bights 26, 28 or by physical engagement of the leading edge of the sheet of paper with bights 26, 28 formed between two pairs of opposed sheet drive rollers 30, 32 and pinch rollers 34, 35. The drive rollers are preferably substantially equally spaced on each side of the centerline C of the direction of travel of the paper through the printer although the spacing distances from the centerline of paper travel will not always be equal due to varying widths of paper which can be handled by the printer.

The sheet drive rollers 30, 32 are preferably mounted on a single rotatable horizontally oriented shaft 38 which is intermittently rotated by an electric sheet drive motor 40 and associated gears 42, 44.

A pair of arcuate paper guides 50, 60 respectively having a convex surface and a concave surface closely spaced from the convex surface and upper printer structure 70 shown in part, define a paper path therebetween to guide the leading edge of a sheet of paper from the sheet feed roller or rollers 12, 14 to the bights 26, 28. The pinch rollers 34, 36 are mounted on a horizontally oriented shaft 46 or a plurality of separate shafts and the pinch rollers comprise idler rollers which are rotatable only during rotation of the sheet drive rollers due to contact with the drive rollers or a sheet of paper engaged between the drive rollers 30, 32 and the pinch rollers 34, 36.

Figure 4:
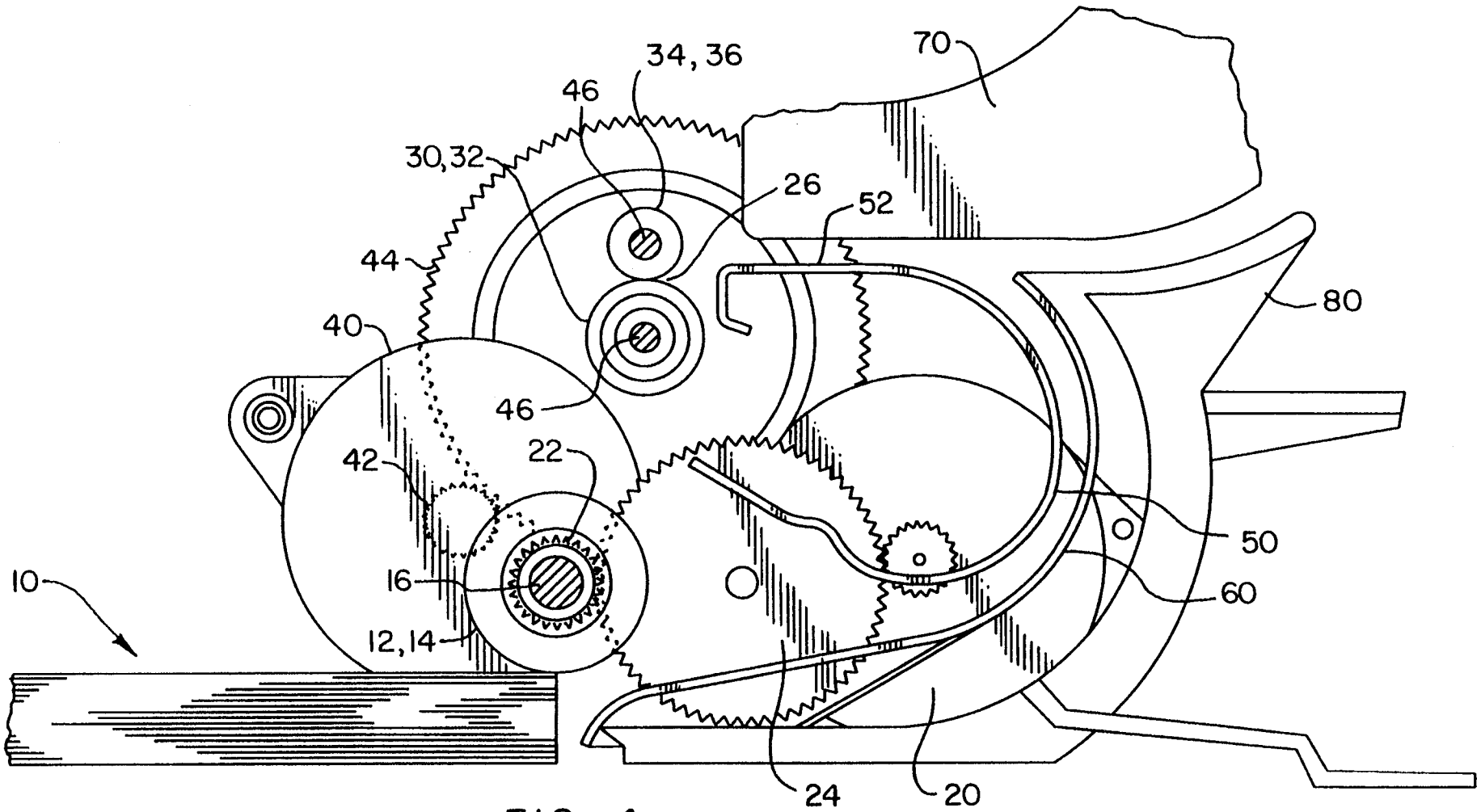
FIG. 4 is a schematic right side elevation view of the sheet feeder of FIG. 3.

As best seen in FIG. 4, the arcuate paper guide 50 having a convex paper guide surface terminates in a horizontally oriented shelf 52 which supports the leading edge of a sheet of paper and, together with the upper printer structure 70, defines a chute to guide the paper to the bights 26, 28 between the pinch rollers and the drive rollers.

As used herein, the term "holding station" refers to the location of a sheet of paper after it has been removed from the paper stack and at which the leading edge of the sheet of paper is positioned in non-contacting proximity to or in physical engagement in the bights 26, 28. The printing station is defined as a zone through which the sheet of paper passes while printing takes place thereon. The printing station is downstream of the bights 26, 28 but not necessarily immediately adjacent thereto. It will be appreciated by persons skilled in the art that additional paper guide means, not shown, can be interposed downstream of the opposed drive rollers 30, 32 and pinch rollers 34, 36 to guide the paper through the printing station.

Although not essential to the present invention as set forth in the appended claims, a horizontally moveable paper guide support 80 is provided for moving the concave arcuate paper guide 60 away from the convex arcuate paper guide 50 to open the paper path therebetween to assist in removing paper jams. Also, means, not shown, may be provided for raising and lowering the stack of paper so that the top sheet thereof is, when desired, engaged by the sheet feed roller or rollers 12, 14.

OPERATION

Paper is fed to the printer by first electrically energizing the sheet feed motor 20 to rotate the sheet feed rollers 12, 14 to pick the top sheet off of the stack to move it from the stack into the printer between the guides 50, 60 to the holding station at which time the leading edge of the sheet of paper is in non-contact proximity or in physical contact with each of the two bights 26, 28 defined by the opposed sheet drive rollers 30, 32 and pinch rollers 34, 36 located on opposite sides of the centerline of the path of paper travel. Movement of the sheet of paper is then temporarily stopped. Although movement of the paper can be terminated after engagement of the leading edge of the paper with each of the bights 26, 28, it is preferred that it be stopped before contact has been made so that rotation of the opposed drive rollers and pinch rollers can commence to move a prior sheet of paper completely therebetween before the next following sheet of paper is moved by the feed roller into the bights.

Engagement of the leading edge of the paper with the two spaced non-rotating bights automatically de-skews the paper before it is moved to the printing station. Rotation of the feed rollers can also be terminated when the leading edge of the paper has passed a short distance through both of the bights. A photosensor is positioned upstream of the bights proximate the path of paper travel so as to determine when the leading edge of the paper has contacted both of the bights or has traversed both of the bights by a predetermined distance. The photosensor will then emit an appropriate electric control signal which terminates electrical energization of the sheet feed motor 20 and rotation of the sheet feed rollers 12, 14. Since paper is frequently skewed as it passes from the stack to the bights, the skewing is automatically corrected as soon as the leading edge of the paper contacts both of the bights. If the drive rollers 30, 32 are not rotating, further forward progress of the leading edge of the paper will be arrested as soon as it contacts both of the bights 26, 28 thus automatically straightening or de-skewing the sheet of paper at the bights.

Various means of determining when the leading edge portion of the paper comes into contact with both of the bights can be used including photosensors positioned near each of the bights or progress of the paper for the desired distance can be assured by rotation of the sheet feed rollers for a predetermined interval of time based on the distance of paper travel from the sheet rollers to the bights 26, 28 plus an additional distance factor based on the expected maximum amount of skew which is likely to occasionally take place following which the sheet feed motor 20 is electrically de-energized to terminate rotation of the sheet feed rollers. When the leading edge of the paper engages both of the bights 26, 28 so that the sheet of paper is de-skewed, it is then considered to be resident in the holding station.

During movement of one sheet of paper by the feed rollers 12, 14 to the holding station but before the leading edge reaches the bights 26, 28, the drive rollers 30, 32 can be rotating to move a previously fed sheet of paper from the holding station to the printing station. After a sheet of paper has reached the holding station, the sheet feed rollers 12, 14 may be disengaged from the stack of paper by lowering the stack of paper by means, not shown. It will be appreciated that the speeds imparted to the sheet of paper by the sheet feed rollers 12, 14 and the sheet drive rollers 30, 32 need not necessarily be the same speed although, ordinarily, if the length of paper travel from the sheet feed rollers to the bights 26, 28 is less than the total length of the paper, then the sheet feed rollers and the sheet drive rollers must move the paper at essentially the same speed so that the sheet will smoothly move from the holding station through the printing station.

Computer control of the energizing of the sheet feed motor 20 and the drive motor 40 can be implemented by various algorithms designed to accomplish the objective of first moving a sheet of paper from the stack 10 to the holding station and subsequently moving the paper from the holding station through the printing station at the same or a different rate of speed. In such an arrangement, the printer speed can be increased by immediately moving a sheet of paper to a holding station while the immediately proceeding sheet of paper is being printed upon. Accordingly, the sheet of paper need not move all of the way from the stack to the printing station in a continuous movement. Thus, the sheet feed rollers 12, 14 can move a sheet of paper at a faster rate of speed to the holding station than the speed of movement of the sheet of paper from the holding station through the printing station under rotation of the sheet drive rollers 30, 32. This speeds printer operation and also automatically deskews the sheet of paper as necessary.

Persons skilled in the art will readily appreciate that various modifications can be made from the preferred embodiment thus the scope of protection is intended to be defined only by the limitations of the appended claims. For example, it is possible to construct a paper feed arrangement in accordance with the teachings of the present invention in which paper sheets are moved from the bottom rather than the top of a paper stack.

We claim:

1. A method of feeding sheets of paper from a stack thereof in a continuous path of paper travel through a computer-driven printer/plotter having a reciprocating print head comprising the steps of:

a) rotating a sheet feed roller which engages a leading edge portion of a sheet of paper in said stack to move said paper along a first portion of said path from said stack to a holding station in said printer at a first rate of speed;

b) guiding said sheet of paper in movement along said first portion of said path from said stack to said holding station where the leading edge of said sheet of paper is proximate a pair of spaced bights between spaced pairs of opposed sheet drive and pinch rollers in the printer and at which further movement of the sheet of paper is temporarily stopped;

c) terminating movement of paper from said stack by said sheet feed roller; and d) commencing rotation of said drive rollers to move said sheet of paper along a second portion of said path of travel between said drive rollers and said pinch rollers at a second rate of speed slower than said first rate of speed, said second portion of said path of travel extending from said holding station through a printing station when the leading edge portion of said paper is engaged with each of said bights at said holding station, said bights being defined by opposed sheet drive rollers and pinch rollers located on opposite sides of the centerline of the path of paper travel.

2. The method of claim 1, wherein said paper movement is arrested at said holding station by engagement of the leading edge of said sheet with said pair of spaced bights.

3. The method of claim 2, further comprising the steps of rotating said feed roller until said leading edge of said sheet of paper has been moved a predetermined distance between said bights and thereafter terminating rotation of said feed roller.

4. The method of claim 1, wherein movement of paper from said stack by said sheet feed roller is terminated by terminating rotation of said sheet feed roller.

5. The method of claim 1, wherein movement of paper from said stack by said sheet feed roller is terminated by disengaging said sheet feed roller from said stack.

6. A sheet feeder for a computer-driven printer having a reciprocating print head comprising:

a) a sheet feed roller and means for intermittently rotating said sheet feed roller to feed a sheet of paper along a first portion of a continuous path of paper travel at a first rate of speed from a stack of paper to a holding station;

b) at least one sheet drive roller on each side of and spaced from the centerline of paper travel and means for intermittently rotating said drive rollers to move a sheet of paper at a second rate of speed slower than said first rate of speed along a second portion of said path extending from said holding station to a printing station;

c) a plurality of pinch rollers between said holding station and said printing station, each said pinch roller being opposed to sand biased toward an associated drive roller to define a paper path therebetween;

d) guide means for guiding a sheet of paper from said stack to position the leading edge thereof in bights between said opposed drive rollers and pinch rollers; and e) roller drive timing means for energizing said means for intermittently rotating said sheet feed roller to move said sheet until the leading edge thereof is engaged with each of said bights and thereafter energizing said means for intermittently rotating said drive rollers to move said sheet through said bights to said printing station.

7. The sheet feeder of claim 6, wherein said means for intermittently rotating said feed roller comprises a first motor and said means for intermittently rotating said drive rollers comprises a second motor.

8. The sheet feeder of claim 7, further comprising a horizontal feed roller drive shaft, a plurality of said feed rollers mounted on said shaft, a horizontal drive roller drive shaft, said drive rollers being mounted thereon, said drive roller shaft being at a higher elevation than said feed roller shaft.

9. The sheet feeder of claim 8, wherein said paper guide means includes spaced arcuate convex and concave surfaces defining a paper path therebetween.

10. The sheet feeder of claim 9, further comprising a paper support shelf at the end of said arcuate convex surface, said shelf having an edge for supporting said sheet of paper proximate said bights.

* * * * *